US006298614B1

(12) United States Patent
Fisher

(10) Patent No.: US 6,298,614 B1
(45) Date of Patent: Oct. 9, 2001

(54) WINDOW FRAME

(76) Inventor: Myles A. Fisher, 2006 E. Mallory St., Pensacola, FL (US) 32503

( * ) Notice: Subject to any disclaimer, the term of this patent is extended or adjusted under 35 U.S.C. 154(b) by 0 days.

(21) Appl. No.: 09/437,541

(22) Filed: Nov. 10, 1999

(51) Int. Cl.[7] ..... E06B 1/04

(52) U.S. Cl. ..... 52/204.1; 52/217; 52/738.1; 52/100

(58) Field of Search ..... 52/204.53, 204.55, 52/208, 656.4, 656.5, 730.2, 730.3, 730.4, 211, 730.6

(56) References Cited

U.S. PATENT DOCUMENTS

D. 382,652 * 8/1997 Colitto ..... D25/122
4,110,942 * 9/1978 Slocomb, Jr. ..... 52/100
5,392,574 2/1995 Sayers ..... 52/217
5,522,196 * 6/1996 Conroy et al. ..... 52/738.1
5,660,010 8/1997 Sayers ..... 52/217

* cited by examiner

*Primary Examiner*—Christopher T. Kent
*Assistant Examiner*—Steve Varner
(74) *Attorney, Agent, or Firm*—Peter Loffler

(57) ABSTRACT

A window frame for installation onto a structure having exterior siding, the window frame helping to prevent moisture from penetrating into the interior of the structure. The window frame has a frame member onto which is installed a window pane and a C-tunnel, the C-tunnel having a first flange, a second flange that extends outwardly from the first flange in non-perpendicular fashion, and a third flange extending outwardly from the second flange in non-perpendicular fashion. A fourth flange extends along a length of the second flange and acts as a rain stop. Diagonal as well as vertical channels may be located on the second flange.

40 Claims, 9 Drawing Sheets

WINDOW FRAME

BACKGROUND OF THE INVENTION

1. Field of the Invention

The present invention relates to a window frame that is installed in a structure having exterior siding, the window frame having properties to help prevent moisture from entering the interior of the structure .

2. Background of the Prior Art

One of the problems associated with window frames that are installed in housing that has a siding exterior, such as is common in the construction of manufactured housing that typically utilizes lay-type siding made from vinyl or aluminum, is the exclusion of rain from the interior of the house. The rain enters the house through gaps that are found between the frame and the housing. These gaps are created during installation, often as a result of substandard construction practices, or during expansion and contraction of the frame and the siding due to temperature fluctuations.

In order to combat the problem of rain penetration, many solutions have been proposed. These solutions rely on creating a perfect or near perfect seal of the frame to the housing and relying on the seal holding in order to prevent moisture bypass. While the various prior art solutions work with varying degrees of efficiency, they can still fail if the frame is improperly installed onto the housing, a problem that is not nonexistent. Additionally, gaps may form as the house settles and shifts over time. In any cause, a small failure of the seal may cause substantial rain moisture to be blown past and penetrate gaps and migrate into the interior of the building, causing water damage, wood rot, or termite infestation.

Therefore, there is a need in the art for a window frame that is installed onto a structure having exterior siding wherein the device will prevent moisture from bypassing the device and entering into the structure. Such a device must work well even if the nature of frame is installed is less than ideal. Additionally, the window frame must prevent moisture bypass over time, even as the housing shifts and settles. Furthermore, the window frame must not be unduly expensive to manufacture and should be relatively simple and straightforward to install.

SUMMARY OF THE INVENTION

The window frame of the present invention addresses the aforementioned needs in the art. The window frame is designed to be installed in an opening of a structure having a siding exterior. The window frame helps prevent moisture from penetrating into the interior of the structure, even if the frame was imperfectly installed and even after the structure has settled and shifted over time.

The window frame of the present invention comprises a window frame member and a C-tunnel attached to the frame member, the C-tunnel comprising a first flange having a first face and a second face, the first flange circumscribing the opening of the structure whereat the window frame will be installed, a second flange, having a third face and a fourth face, the second flange extending outwardly from the first flange in a non-perpendicular direction to the first flange, and a third flange, having a fifth face facing the first face and a sixth face, the third flange extending outwardly from the second flange in a non-perpendicular direction to the second flange. If desired, a fourth flange extends along a length of the C-tunnel advantageously along a length of the second flange proximate the first flange. A first channel is located on the third face of the second flange and extends diagonally downwardly from the either proximate the first flange or if used, proximate the fourth flange toward the third flange. A second channel extends downwardly along a length of the third face of the second flange. If a plurality of first channels are used, the second channel extends between two adjacent first channels (or between a first channel and the end of the second flange). The window frame member, the C-tunnel, and the fourth flange, can all be integrally formed, by extrusion (of vinyl, aluminum or other suitable material) or other appropriate technique.

BRIEF DESCRIPTION OF THE DRAWINGS

Similar reference numerals refer to similar parts throughout the several views of the drawings.

DESCRIPTION OF THE PREFERRED EMBODIMENT

Figure 1:
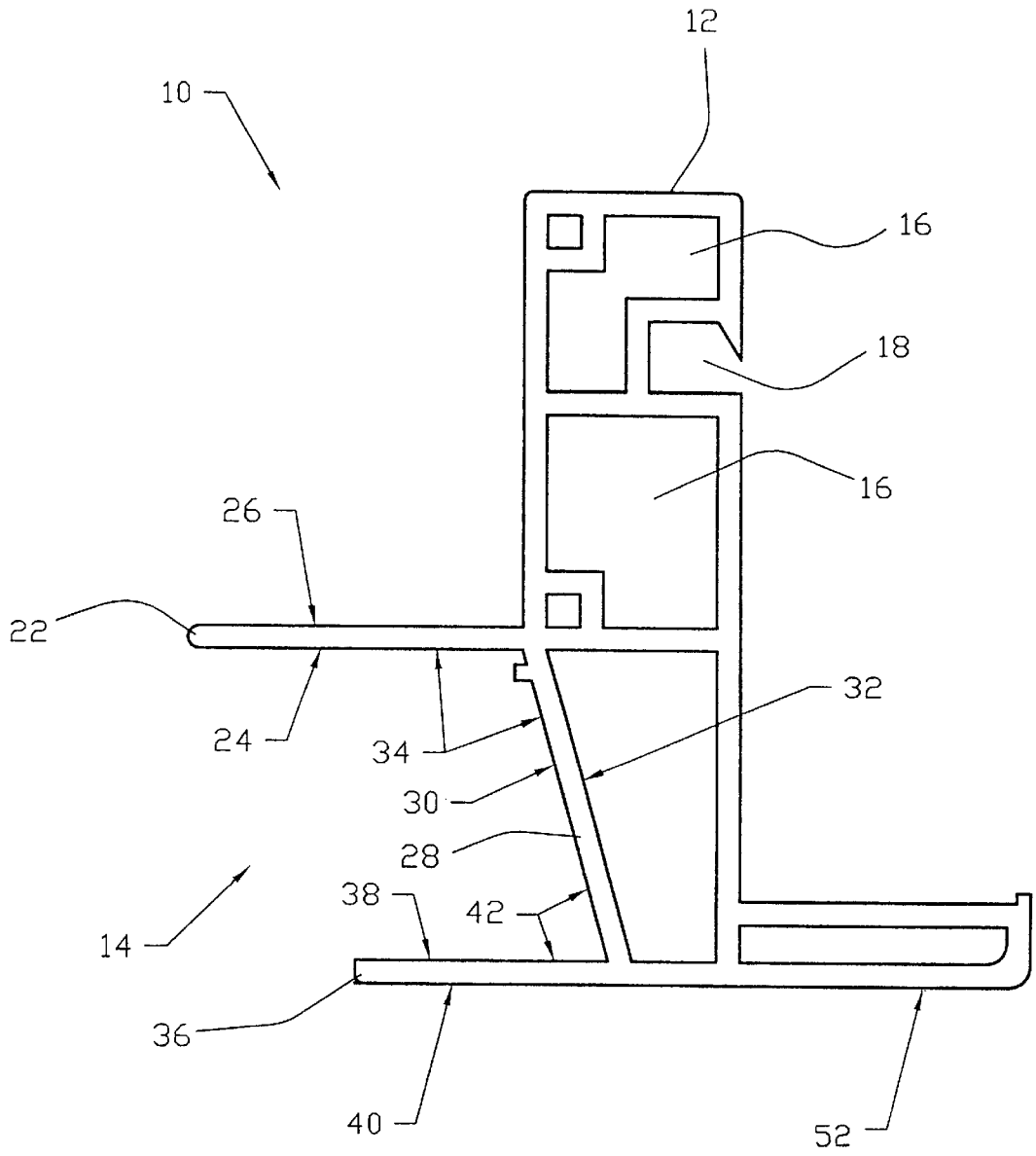
FIG. 1 is a top plan view of the window frame of the present invention.
Figure 2:
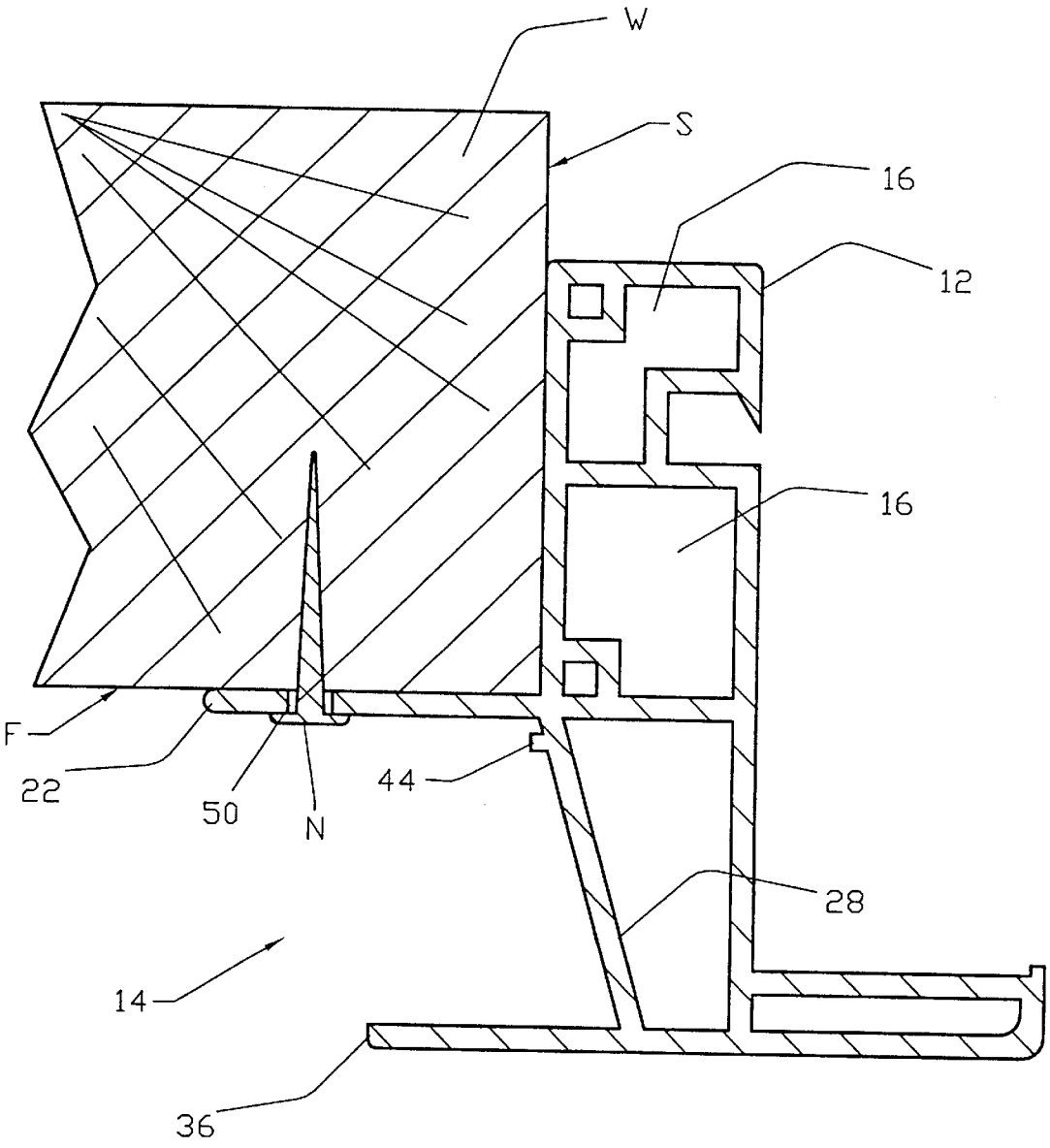
FIG. 2 is a sectioned top plan view of the window frame attached to a structure.
Figure 3:
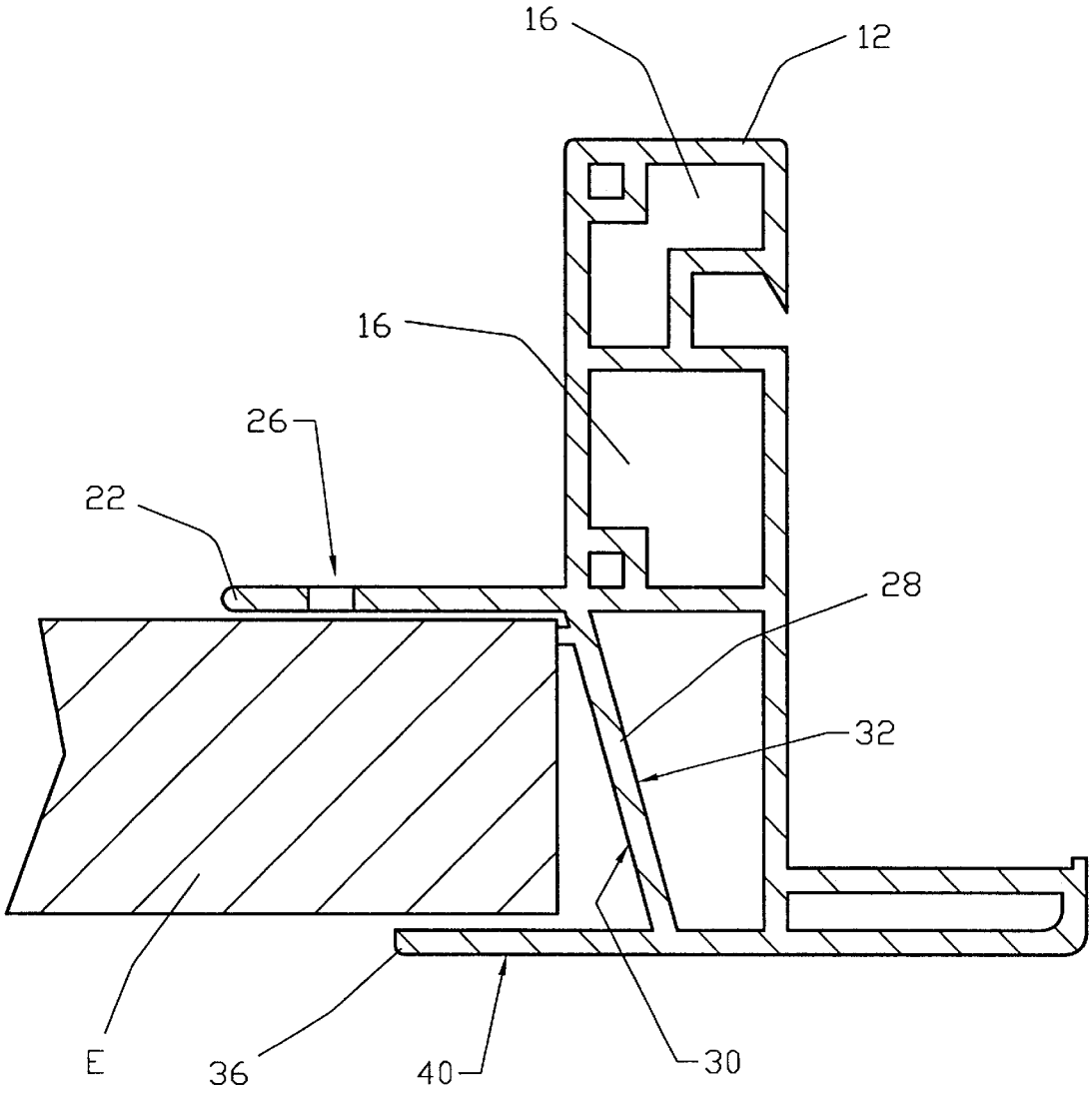
FIG. 3 is a sectioned top plan view of the window frame receiving siding.
Figure 4:
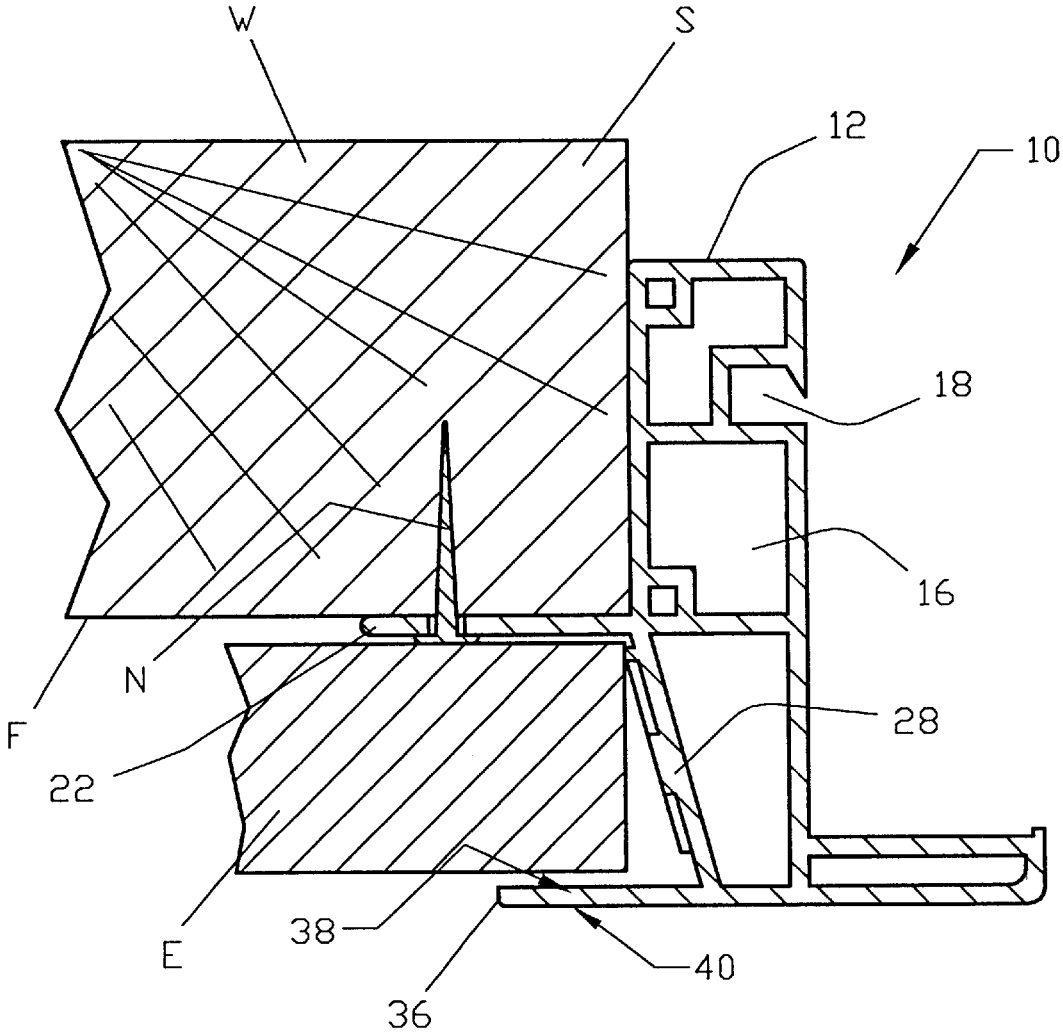
FIG. 4 is a sectioned top plan view of the window frame attached to a structure and receiving siding.
Figure 6:
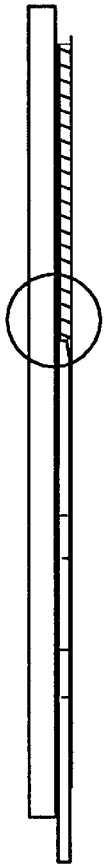
FIG. 6 is a side elevation view of FIG. 5.
Figure 5:
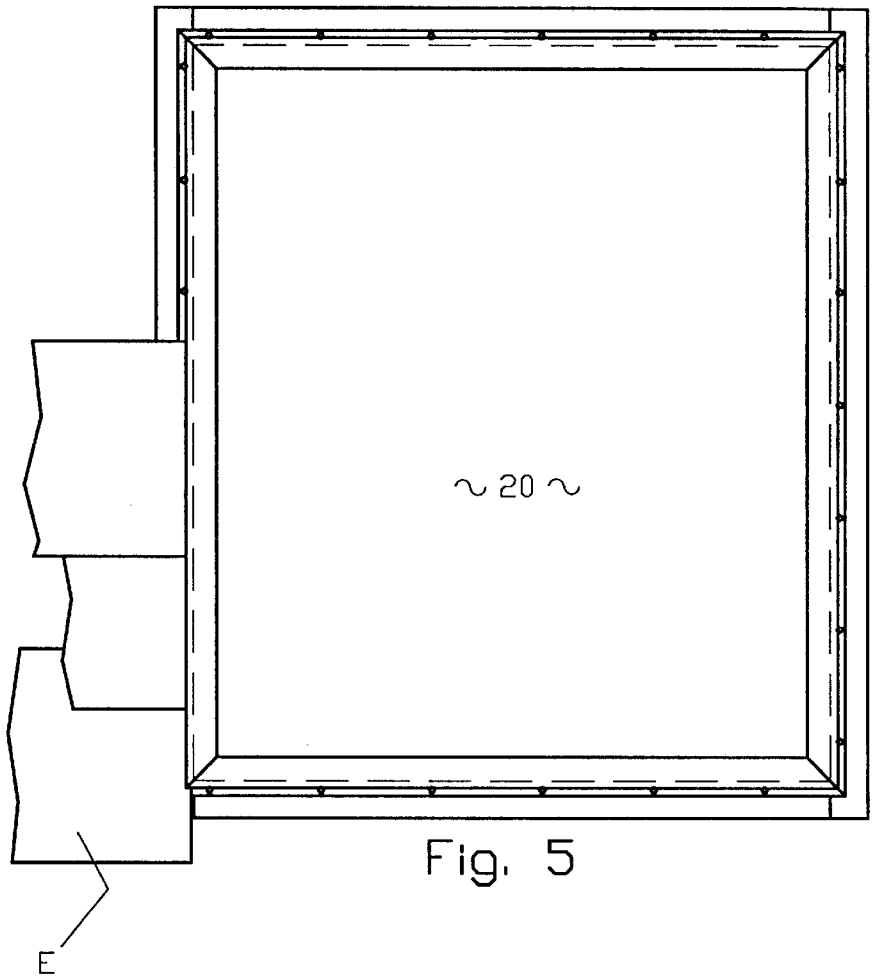
FIG. 5 is a front elevation view of the window frame receiving sections of siding.
Figure 7:
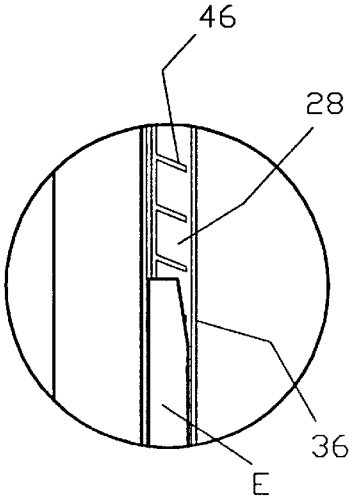
FIG. 7 is an enlarged view of a section of FIG. 6.

Referring now to the drawings, it is seen that the window frame of the present invention, generally denoted by reference numeral 10 is comprised of a window frame member 12 and a C-tunnel 14 attached to the window frame member 12. The window frame member 12 may have the multiple cell 16 structure for added structural integrity and has a glazing pocket 18 for attaching the window glazing 20 thereon. The C-tunnel 14 has a first flange 22 that has a first face 24 and a second face 26, a second flange 28 that a third face 30 and a fourth face 32, the second flange 28 extending outwardly from the first flange 22 in a non-perpendicular direction to the first flange 22 such that the first face 24 and the third face 30 form a first angle 34 that is a non-right angle and specifically that is obtuse. The C-tunnel 14 also has a third flange 36 that has a fifth face 38 facing the first face 24 and a sixth face 40, the third flange 36 extending outwardly from the second flange 28 in a non-perpendicular direction to the second flange 28 such that the third face 30 and the fifth face 38 form a second angle 42 that is a non-right angle and specifically that is acute. If desired, a fourth flange 44 extends along a length of the C-tunnel 14 advantageously along a length—either a partial length or substantially the entire length—of the second flange 28, the fourth flange 44 being located proximate the first flange 22. The window frame member 12 and the C-tunnel 14 can be formed as an integral unit or as two separate units attached together in appropriate fashion. Further, the fourth flange 44 can be formed integrally with the C-tunnel 14 or can be attached thereto in appropriate fashion.

Figure 9:
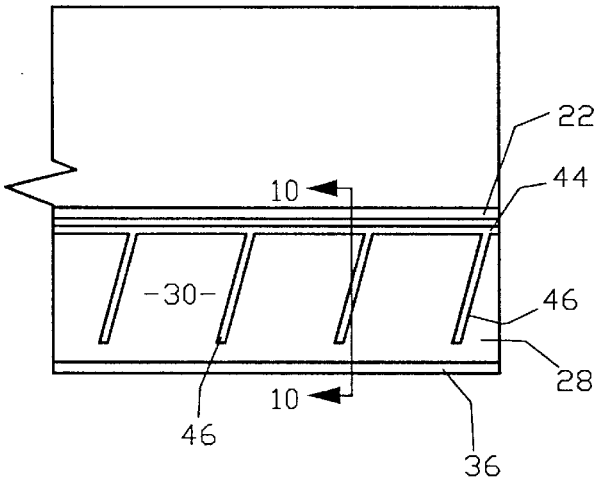
FIG. 9 is a front elevation view of a portion of the window frame utilizing generally diagonal channels.
Figure 8:
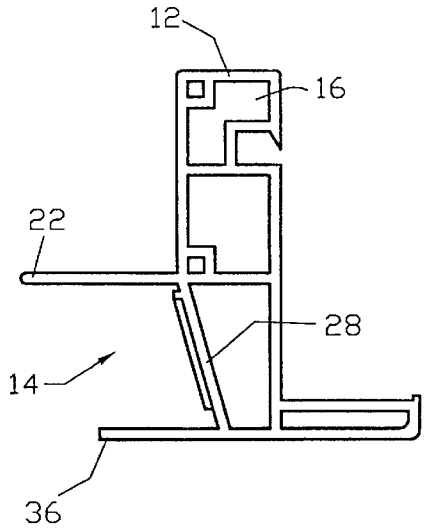
FIG. 8 is a top plan view of the window frame utilizing generally diagonal channels.
Figure 10:
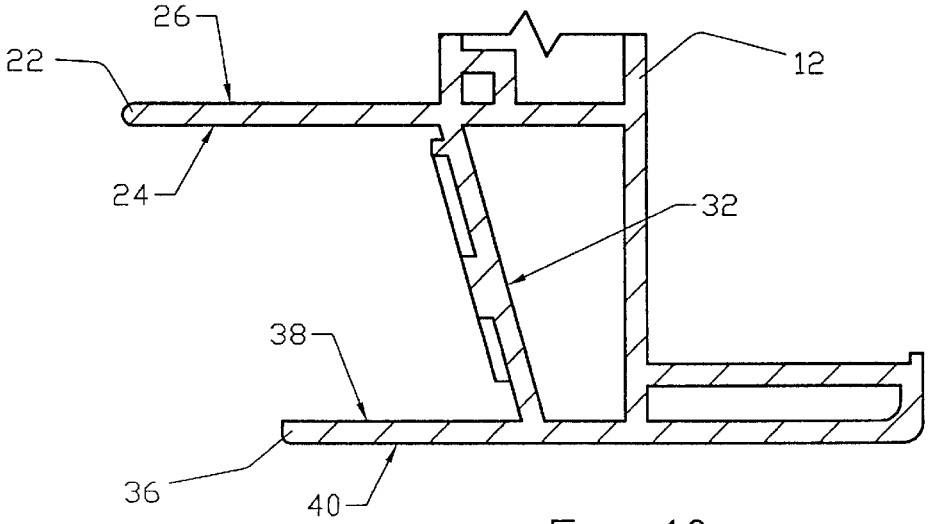
FIG. 10 is a sectioned view of the window frame taken along line 10—10 in FIG. 9.
Figure 11:
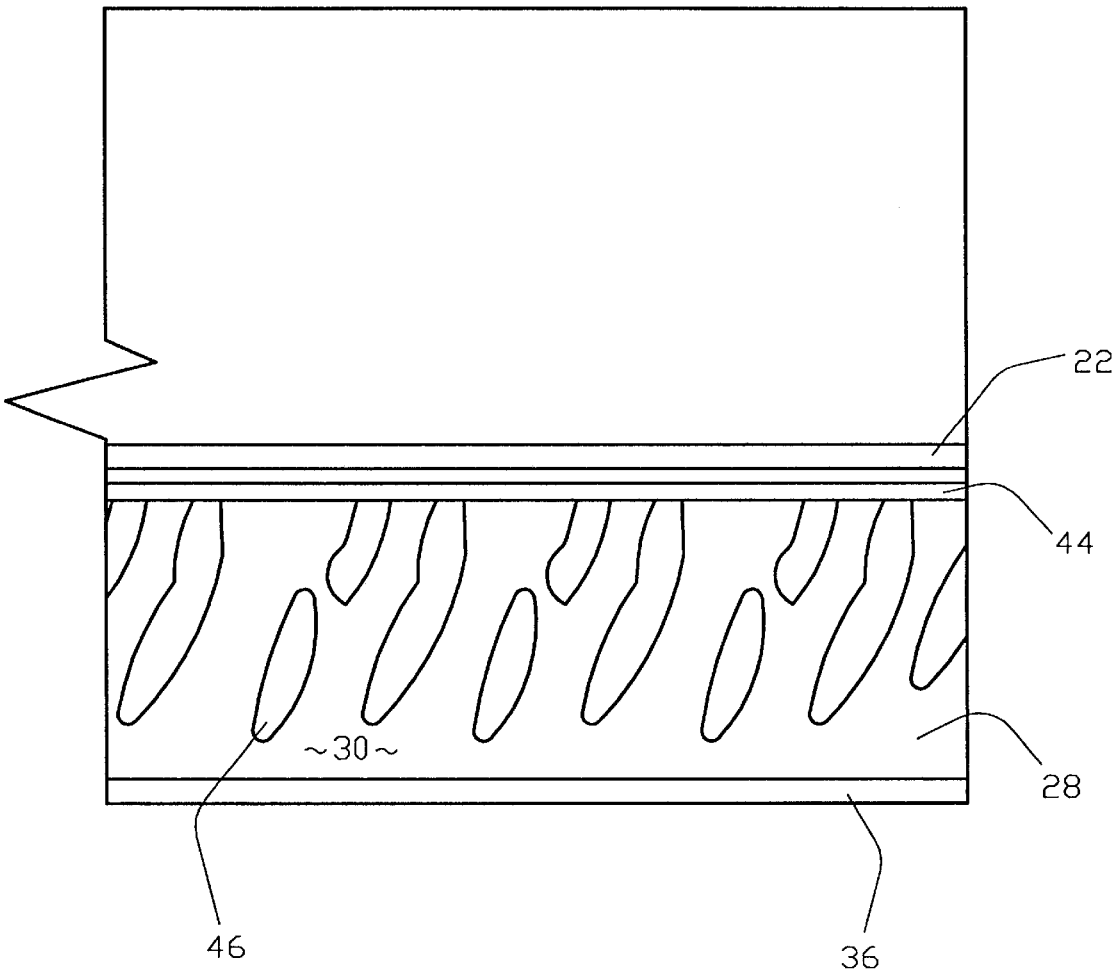
FIG. 11 is a front elevation view of a portion of the window frame utilizing generally diagonal channels which are free form.
Figure 12:
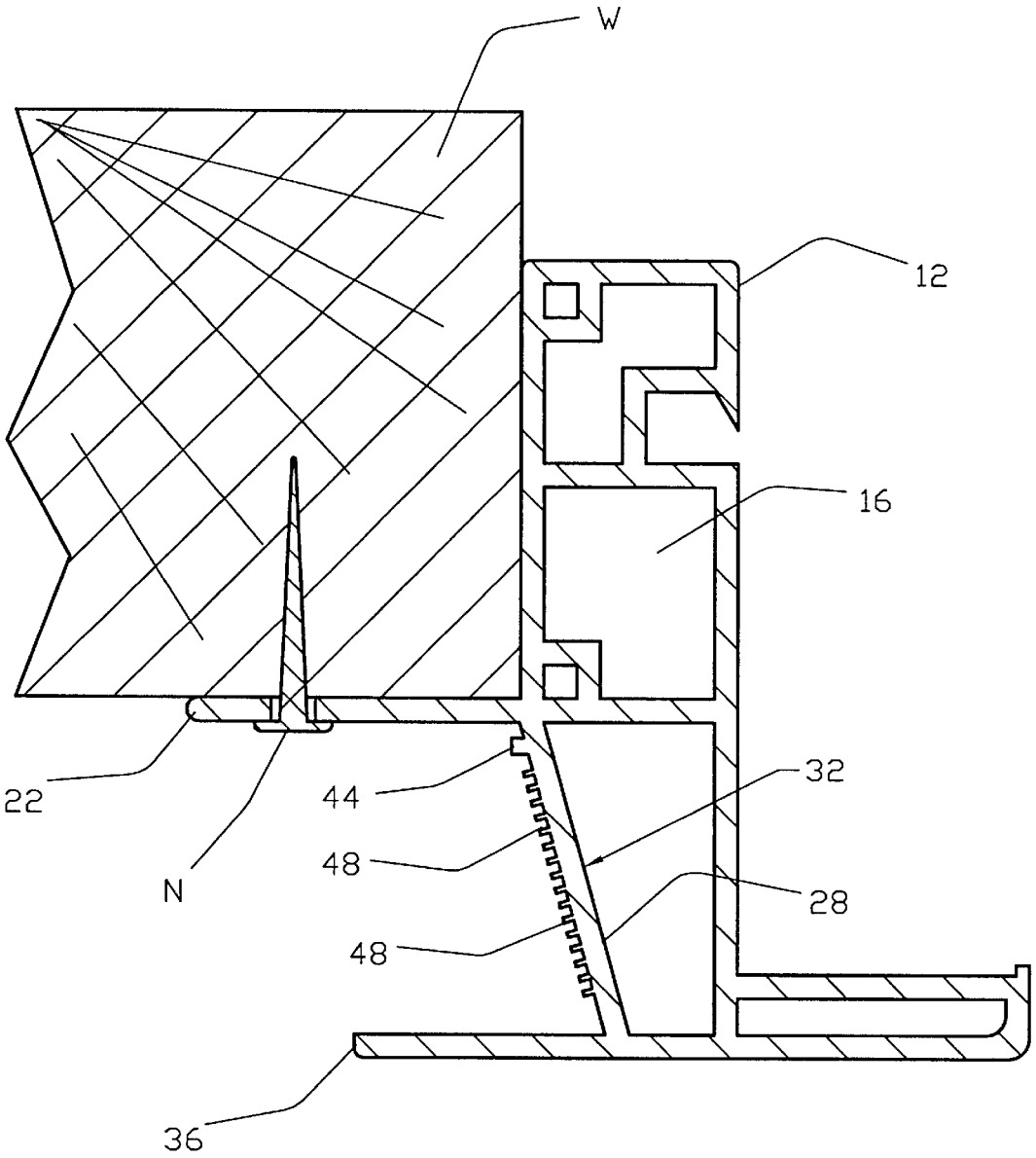
FIG. 12 is a sectioned top plan view of the window frame utilizing generally vertical channels.
Figure 13:
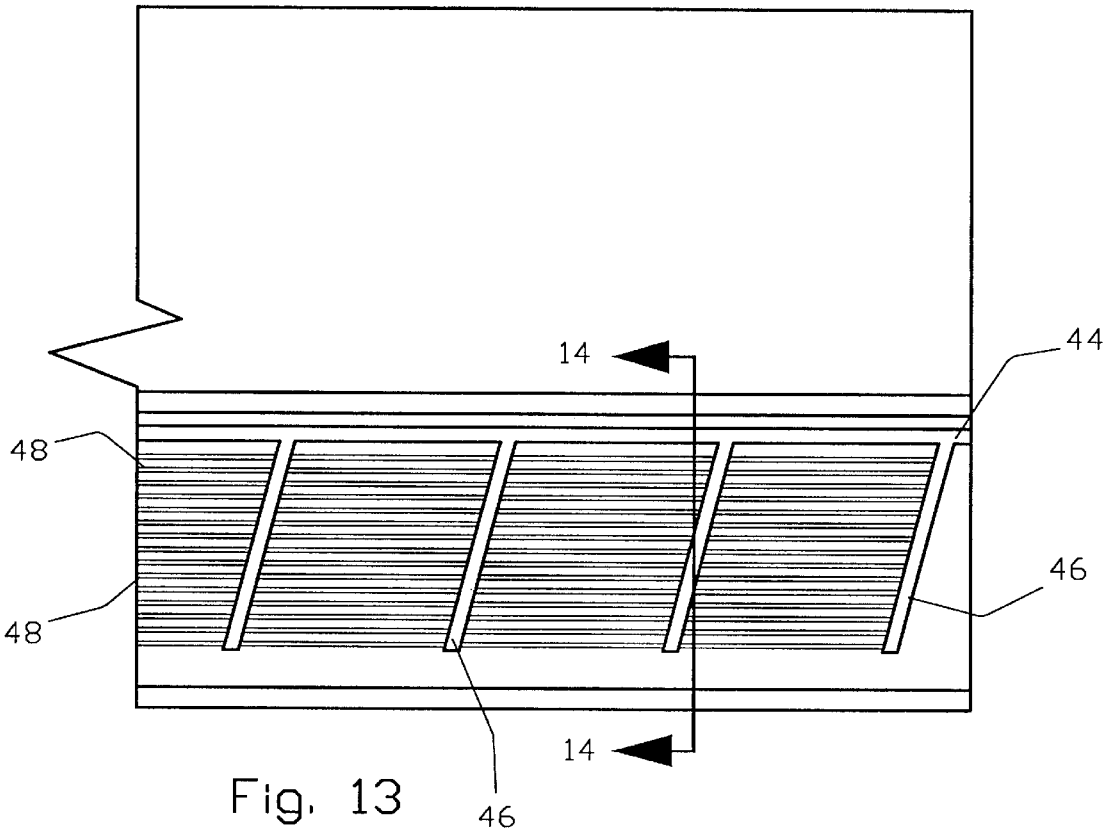
FIG. 13 is a front elevation view of a portion of the window frame utilizing generally diagonal channels and generally vertical channels.
Figure 14:
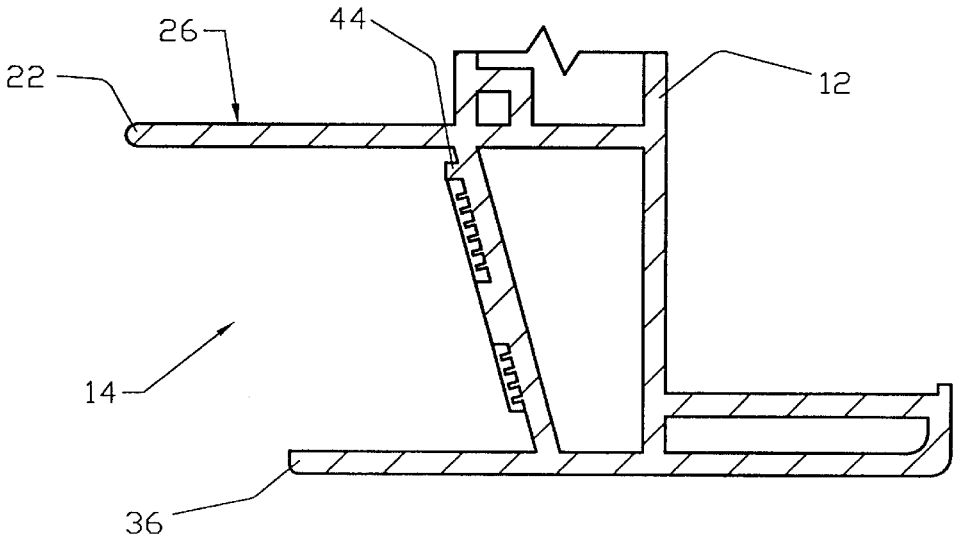
FIG. 14 is a sectioned view of the window frame taken along line 14—14 in FIG. 9.

A first channel 46 is located on the third face 30 of the second flange 28 and extends generally diagonally downwardly from the either proximate the first flange 22 or if used, the fourth flange 44 toward the third flange 36. This first channel 46 may be either generally straight as best illustrated in FIGS. 9 and 14 or may be generally free form as illustrated in FIG. 11. This first channel 46 may be formed by providing either raised portions on the third face 30, the raised portions acting as the outer edges of the first channel 46 or a depressed portion, the depressed portion being the actual first channel 46. At least one second channel 48 extends downwardly along a length—either the partial length or substantially the entire length of the third face 30 of the second flange 28. As with the first channel 46, the second channel 48 may be either generally straight or may be generally free form. This second channel 48 may be formed by providing either raised portions on the third face 30, the raised portions acting as the outer edges of the second channel 48 or a depressed portion, the depressed portion being the actual second channel 48. The device 10 may be made with either a first channel 46, a second channel 46 or both.

If a plurality of first channels 46 are used, the second channel 48 extends between two adjacent first channels 36 (or between a first channel 46 and the end of the second flange 28). If raised portions are used to form the channels 46 and 48, then the lower boundary of the first channel 46 is a continuous portion while the ends of the second channel 48 may form the upper boundary of the first channel 46. In such an arrangement, water that is captured by the second channel 48 is channeled downwardly until it drains into the nearest first channel 46 which channels it away from the first flange 22. A glazing seat 52 extends along a side of the frame member 12 opposite the side to which the C-tunnel 14 is attached.

In order to use the window frame 10 of the present invention, the device 10 is positioned within an opening of the structure to which it will be attached. The first flange 22 circumscribes the opening such that the second face 26 faces the outer face F of the wall W of the structure with a portion of the window frame member 12 facing a side wall S of the structure. The device 10 is secured by passing appropriate nails N through openings 50 located along the length of the first flange 22. If the glazing 20 has not already be attached to the window frame member 12, it is now attached in appropriate fashion. Thereafter, the exterior siding E is positioned so as to be received within the C-tunnel 14 and abuts the fourth flange 44 (or the second flange 28, if no fourth flange 44 is used). The exterior siding E is attached to the structure in appropriate fashion. Any moisture that passes between the exterior siding E and the third flange 36 will enter the C-tunnel 14 such due to the relative angle of the second flange 28, the moisture will hit the second flange 28 at a relatively low angle of incidence (angle between the normal and the face of the second flange 28) a portion of the incoming moisture will reflect back toward the third flange 36 wherein the second flange 28 and the third flange 28—being joined at an acute angle—will act as a channel to channel the moisture downwardly wherein the moisture will drop off of the sill (lower horizontal C-tunnel section). Some of the moisture will reflect directly back to the exterior siding E eventually being captured in the second channel 48 wherein it will be channeled into the first channel 46 wherein it will be channeled into the channel defined by the second flange 28 and the third flange 36 and finally will drop off of the sill. A small portion of the moisture may proceed toward the first flange 22 wherein it will be stopped by the fourth flange 44 which will cause the moisture to enter the second channel 48, then to the first channel 46, and then to the channel defined by the second flange 28 and the third flange 36 and then drop off of the sill.

While the invention has been particularly shown and described with reference to embodiments thereof, it will be appreciated by those skilled in the art that various changes in form and detail may be made without departing from the spirit and scope of the invention.

What is claimed is:

1. A window frame for installation in an opening of a structure comprising:

a window frame member;

a C-tunnel attached to the frame member, the C-tunnel having a) a first flange having a first face and a second face, b) a second flange, having a third face and a fourth face, the second flange extending outwardly from the first flange in a non-perpendicular direction to the first flange, and c) a third flange, having a fifth face facing the first face and a sixth face, the third flange extending outwardly from the second flange in a non-perpendicular direction to the second flange; and a first channel located on the third face of the second flange and extending diagonally downwardly from proximate the first flange toward the third flange.

2. The window frame as in claim 1 further comprising a fourth flange extending along a length of the C-tunnel.

3. The window frame as in claim 1 further comprising a second channel located on the third face extending downwardly along a portion of the third face of the second flange.

4. The window frame as in claim 1 wherein the window frame member is integrally formed with the C-tunnel.

5. The window frame as in claim 1 wherein the window frame member is integrally formed with the C-tunnel and the fourth flange is integrally formed with the C-tunnel.

6. The window frame as in claim 1 wherein the first flange circumscribes the opening.

7. A window frame for installation in an opening of a structure comprising:

a window frame member;

a C-tunnel attached to the frame member, the C-tunnel having a) a first flange having a first face and a second face, b) a second flange, having a third face and a fourth face, the second flange extending outwardly from the first flange, the first face and the third face forming a first angle, the first angle being an obtuse angle, whereby, moisture entering the frame member is deflected toward the third flange and c) a third flange, having a fifth face facing the first face and a sixth face, the third flange extending outwardly from the second flange, the third face and the fifth face forming a second angle, the second angle being an acute angle; and wherein the first flange serves as a nail fin for attaching the window frame to the structure.

8. The window frame as in claim 7 further comprising a fourth flange extending along a length of the C-tunnel.

9. The window frame as in claim 7 further comprising a fourth flange extending along a length of the second flange.

10. The window frame as in claim 9 further comprising a first channel located on the third face of the second flange and extending diagonally downwardly from the proximate fourth flange toward the third flange.

11. The window frame as in claim 10 further comprising a second channel located on the third face extending downwardly along a portion of the third face of the second flange.

12. The window frame as in claim 10 further comprising a second channel located on the third face extending along a portion of the third face of the second flange generally parallel to the fourth flange.

13. The window frame as in claim 7 further comprising a first channel located on the third face of the second flange and extending diagonally downwardly from proximate the first flange toward the third flange.

14. The window frame as in claim 13 further comprising a second channel located on the third face extending downwardly along a portion of the third face of the second flange.

15. The window frame as in claim 7 further comprising:

a plurality of first channels located on the third face of the second flange in spaced apart fashion and extending diagonally downwardly from proximate the first flange toward the third flange; and a second channel located on the third face of the second flange and extending between a pair of adjacent first channels.

16. The window frame as in claim 9 further comprising:

a plurality of first channels located on the third face of the second flange in spaced apart fashion and extending diagonally downwardly from proximate the fourth flange toward the third flange; and a second channel located on the third face of the second flange and extending between a pair of adjacent first channels.

17. The window frame as in claim 7 wherein the window frame meter is integrally formed with the C-tunnel.

18. The window frame as in claim 7 wherein the window frame member is integrally formed with the C-tunnel and the fourth flange is integrally formed with the C-tunnel.

19. The window frame as in claim 7 wherein the first flange circumscribes the opening.

20. A window frame for installation in an opening of a structure comprising:

a window frame member;

a C-tunnel attached to a first side of the frame member, the C-tunnel having a) a first flange having a first face and a second face, b) a second flange, having a third face and a fourth face, the second flange extending outwardly from the first flange, the first face and the third face forming a first angle, the first angle being an obtuse angle, whereby, moisture entering the frame member is deflected toward the third flange and c) a third flange, having a fifth face facing the first face and a sixth face, the third flange extending outwardly from the second flange, the third face and the fifth face forming a second angle, the second angle being an obtuse angle; and a glazing seat extending along a length of an opposing second side of the frame member adapted to receive and secure glazing to the frame member along the second side.

21. The window frame as in claim 20 further comprising a fourth flange extending along a length of the C-tunnel.

22. The window frame as in claim 20 further comprising a fourth flange extending along a length of the second flange.

23. The window frame as in claim 22 further comprising a first channel located on the third face of the second flange and extending diagonally downwardly from the proximate fourth flange toward the third flange.

24. The window frame as in claim 23 further comprising a second channel located on the third face extending downwardly along a portion of the third face of the second flange.

25. The window frame as in claim 23 further comprising a second channel located on the third face extending along a portion of the third face of the second flange generally parallel to the fourth flange.

26. The window frame as in claim 20 further comprising a first channel located on the third face of the second flange and extending diagonally downwardly from proximate the first flange toward the third flange.

27. The window frame as in claim 26 further comprising a second channel located on the third face extending downwardly along a portion of the third face of the second flange.

28. The window frame as in claim 20 further comprising:

a plurality of first channels located on the third face of the second flange in spaced apart fashion and extending diagonally downwardly from proximate the first flange toward the third flange; and a second channel located on the third face of the second flange and extending between a pair of adjacent first channels.

29. The window frame as in claim 23 further comprising:

a plurality of first channels located on the third face of the second flange in spaced apart fashion and extending diagonally downwardly from proximate the fourth flange toward the third flange; and a second channel located on the third face of the second flange and extending between a pair of adjacent first channels.

30. The window frame as in claim 20 wherein the window frame member is integrally formed with the C-tunnel.

31. The window frame as in claim 20 wherein the window frame member is integrally formed with the C-tunnel and the fourth flange is integrally formed with the C-tunnel.

32. The window frame as in claim 20 wherein the first flange circumscribes the opening.

33. A window frame for installation in an opening of a structure comprising:

a window frame member;

a C-tunnel attached to the frame member, the C-tunnel having a) a first flange having a first face and a second face, b) a second flange, having a third face and a fourth face, the second flange extending outwardly from the first flange, the first face and the third face forming a first angle, the first angle being an obtuse angle, whereby, moisture entering the frame member is deflected toward the third flange and c) a third flange, having a fifth face facing the first face and a sixth face, the third flange extending outwardly from the second flange, the third face and the fifth face forming a second angle, the second angle being an obtuse angle; and a first channel located on the third face of the second flange and extending diagonally downwardly from the proximate fourth flange toward the third flange.

34. The window frame as in claim 33 wherein the first angle is obtuse and the second angle is acute.

35. The window frame as in claim 33 further comprising a fourth flange expending along a length of the C-tunnel.

36. The window frame as in claim 33 further comprising a fourth flange extending along a length of the second flange.

37. The window frame as in claim 36 further comprising a second channel located on the third face extending downwardly along a portion of the third face of the second flange.

38. The window frame as in claim 33 wherein the window frame member is integrally formed with the C-tunnel.

39. The window frame as in claim 33 wherein the window frame member is integrally formed with the C-tunnel and the fourth flange is integrally formed with the C-tunnel.

40. The window frame as in claim 33 wherein the first flange circumscribes the opening.

* * * * *